US005813147A

United States Patent [19]

Burnet et al.

[11] Patent Number: 5,813,147

[45] Date of Patent: Sep. 29, 1998

[54] SNOW SHOE SCREENS

[75] Inventors: Christophe Burnet, Mercier; Philippe Gallay, Le Nojak, both of France

[73] Assignee: Techniques Sports Loisirs, Alex, France

[21] Appl. No.: 788,024

[22] Filed: Jan. 24, 1997

[30] Foreign Application Priority Data

Jan. 26, 1996 [FR] France ..... 96 01201
Jun. 10, 1996 [FR] France ..... 96 07387

[51] Int. Cl.[6] ..... A43B 5/04

[52] U.S. Cl. ..... 36/122; 36/125

[58] Field of Search ..... 36/122, 123, 124, 36/125

[56] References Cited

U.S. PATENT DOCUMENTS 3,638,333 2/1972 Sprandel .
3,861,698 1/1975 Greig .
4,045,889 9/1977 Woolworth ..... 36/122
5,014,450 5/1991 McGrath ..... 36/122
5,682,688 11/1997 Gallay ..... 36/122

FOREIGN PATENT DOCUMENTS 2409066 7/1979 France ..... 36/124
WO 96/07457 3/1996 WIPO .

*Primary Examiner*—M. D. Patterson
*Attorney, Agent, or Firm*—Fay, Sharpe, Beall, Fagan, Minnich & McKee

[57] ABSTRACT

A snow shoe (1) has a peripheral frame (2) which defines an interior zone. A central part (14) is disposed centrally in the open zone to receive a binding (5). A plurality of support walls (40) extend transversely between the central part and the peripheral frame. The support walls are downwardly concave, having a central portion (40*c*) disposed between front portions (40*a*) and rear portions (40*b*). Forward downward extending edges (42*a*) extend downward from the front wall portion and rearward downward extending edges (42*b*) extend downward from the rear wall portions.

19 Claims, 10 Drawing Sheets

SNOW SHOE SCREENS

BACKGROUND OF THE INVENTION

The present invention concerns a snow shoe and more specifically an improvement of its screen.

Snow shoes are instruments which have been known for many years because they have been used by the peoples of the Scandinavian countries for several centuries for moving on snow. Until this day, snow shoes are used for utilitarian and military purposes in order to permit the mountain people or mountain troops to move on snow for their daily travel requirements. At the present, snow shoes are also utilized by sports persons for their runs and hikes and even for competitive events. But the athletes, although practicing for their enjoyment, are more and more demanding with respect to the equipment which they use and it is a fact that the products which are currently sold do not provide total satisfaction, and notably when moving on snow.

SUMMARY OF THE INVENTION

The present invention proposes a new shoe, combining at the same time excellent performances in engagement and in ground support, while permitting easy uphill and downhill progression Thus, according to the invention, the snow shoe comprises a peripheral frame, delimiting an interior zone or screen constituted by a set of internal support walls, and is characterized in that at least one of the support walls extends transversely and is constituted by a transverse profile forming a box open toward the bottom, comprising at least one front wall portion extending toward the front and toward the bottom and a rear wall portion extending toward the rear and the bottom, with the two wall portions converging toward the top.

According to an additional characteristic, the profile extends transversely and presents a transverse general axis.

According to different variations, the profile is symmetrical relative to its general transverse axis, or it is asymmetrical.

According to another characteristic, the width of the support wall(s) varies between the central part and the peripheral frame, in order to decrease, for example, from the center toward the peripheral frame.

In addition, the thickness of the front and/or rear support wall portion (s) and/or the height can vary.

BRIEF DESCRIPTION OF THE DRAWINGS

It should also be noted that the edges of the front wall portion and of the rear wall portion can be in the same horizontal plane or in different planes.

Other characteristics and benefits of the invention are apparent from the description which follows with respect to the attached drawings—and which is provided by way of example only, and not limited thereto.

FIG. 1 is a bird's eye view of the snow shoe with binding, but without the boot.

FIG. 2 is a lateral view, the boot being represented mixed line [dot-dash].

FIG. 3 is a bird's eye view of the snow shoe alone without the binding.

FIG. 4 is a sectional view according to AA of FIG. 3, but at much larger scale.

FIG. 5 is a partial sectional view according to BB of FIG. 4.

DETAILED DESCRIPTION OF THE PREFERRED EMBODIMENTS

Figure 1:
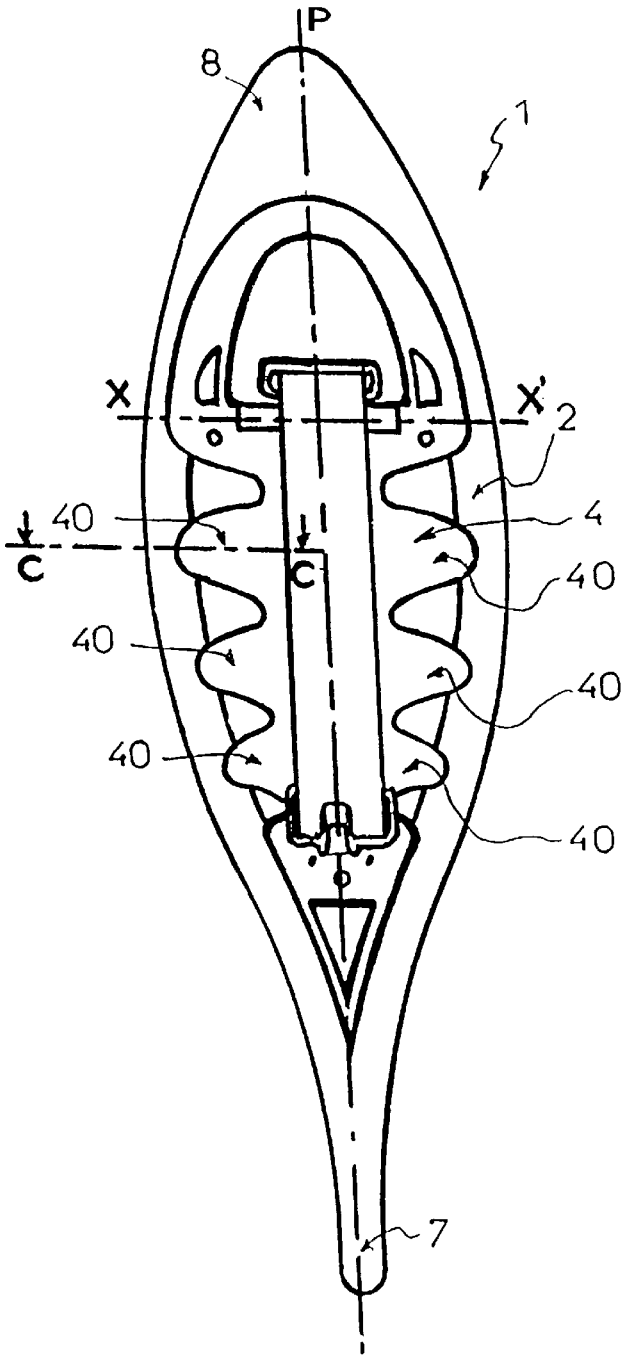
FIGS. 1 to 5 illustrate a first specific embodiment.
Figure 2:
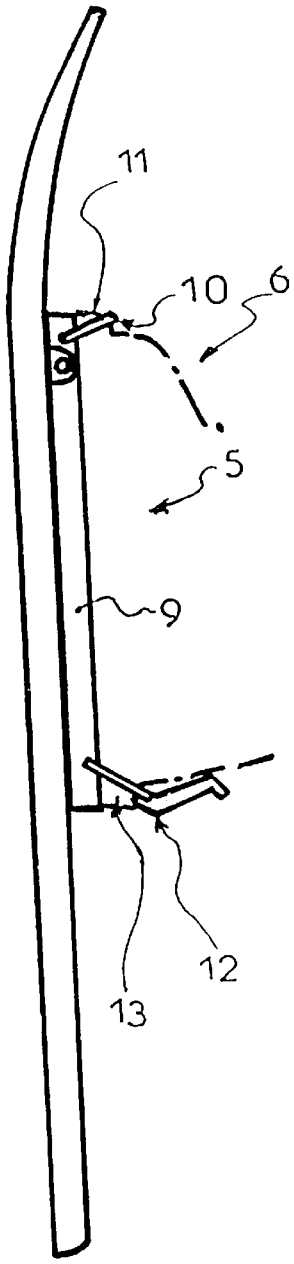

According to a preferred mode of embodiment, the snow shoe designated under general reference (1) is presented in form of a latticed slab in the general plane of symmetry (P) fixed below the boot, which consists of a peripheral frame (2), constituted by at least one peripheral wall, delimiting an interior zone or screen (4) comprising a set of internal walls supporting the binding (5) destined to retain the boot (6) of the user.

Said peripheral frame has a general elongated form, eventually continuing toward the rear into a tail (7) of reduced width, while the front can advantageously be raised and with slightly pointed shape to constitute the front spatula (8). However, the general shape of said snow shoe can be different, as, for example, with rounded front or not having a tail, for example, without going outside of the scope of the invention.

Said screen (4) with its set of internal walls forms a lower general support surface on the snow, permitting that the user will not sink much into the snow, thanks to the relatively large carrying surface of the screen. It should be noted that the binding (5) destined to retain the boot is, according to the illustration furnished by way of example, articulated against the screen (4) of the snow shoe itself according to a transverse axis (XX'). In beneficial fashion, said binding, carrying the general reference (5) is constituted by an articulated sheet (9) comprising retention means for the boot, i.e. front retention means (10) destined to retain the front extremity (11) of the boot and rear retention means (12) destined to retain the rear extremity (13) of said boot.

The screen (4) is constituted, at least in part, by a succession of support wall (40) extending transversely in order to serve, of course, the support surface on the snow, but also to connect the central part (14) supporting the binding (5) with the peripheral frame (2).

According to the preferred mode of the invention, the set of support walls (40) joins the central part (14) with the frame (2); however, certain [support walls] among them may only extend transversely over a reduced length and not be connected to said frame.

The transverse support walls (40) are beneficially constituted by a profile forming a box open toward the bottom, said profile having a general transverse axis (YY') and being formed by a wall succession comprising at least a front wall portion (40*a*) extending toward the front (AV) and toward the bottom (BA) and a portion of the rear wall (40*b*) extending toward the back and toward the bottom, with the two wall portions (40*a*) and (40*b*) converging toward the top. However, according to possible variations of the invention, only some walls (40) may possess said box-type shape.

Figure 4:
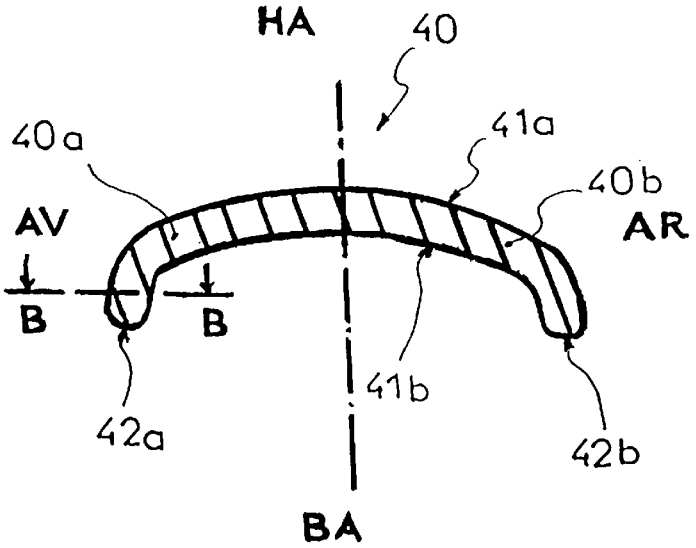

The boxes have a beneficially cambered shape toward the top thanks to the rounded form of the transverse section of portions of the front wall (40*a*) and portions of the rear wall (40*b*) as illustrated in FIG. 4.

Figure 6A:
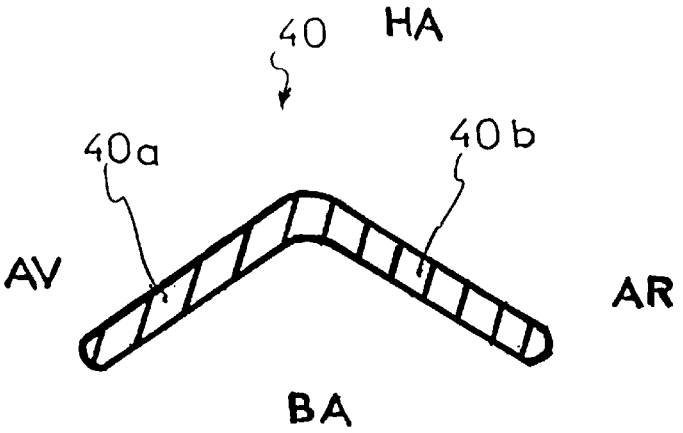
FIGS. 6*a*, 6*b* and 6*c* are sectional views in accordance with AA of a transverse section of the support walls, according to several variations.
Figure 6B:
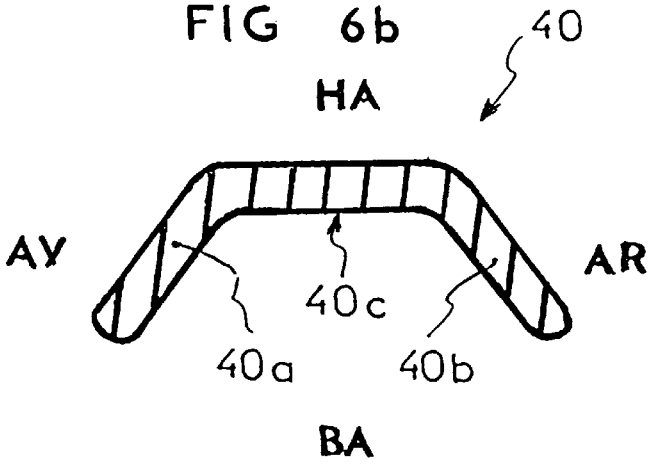

According to possible variations of the invention, the shape of the transverse section of said support wall (40) may be different, without going outside the protected realm of said claim. By transverse section one notes a parallel section to plane P, that is to say, transverse relative to the YY' axis of each of the profiles. Thus, the section may, for example, be in form of a V open toward the bottom (BA), the wall (40) being then formed by two front (40*a*) and rear portions (40*b*) slightly plane, presenting an angle between them, or forming a U, which is also open toward the bottom (BA) thanks to a central plane and horizontal portion (40*c*), bordered laterally by a plane and oblique front portion (40*a*) and rear portion (40*b*), as illustrated in FIGS. 6*a* and 6*b*.

Figure 6C:
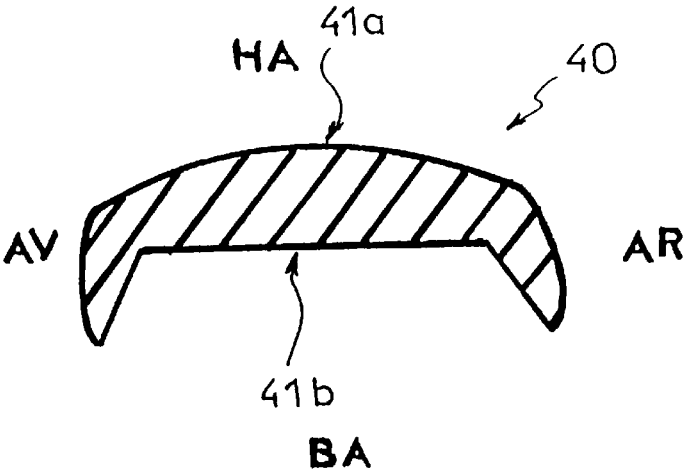

Furthermore, said support walls (40) are delineated by an upper external surface (41*a*) and a lower external surface (41*b*) forming an external envelope with said surfaces having a possible different profile in transverse section, the lower surface (41*b*) being able to form a profile of an inverted U and the upper surface (41*a*) a rounded profile, as illustrated in FIG. 6*c*.

According to the preferred specific embodiment of the invention, the support walls (40) have a transverse section of cambered shape toward the top and their upper (41*a*) and lower (41*b*) external surfaces are slightly parallel to each other in a manner so as to maintain a constant thickness in the transverse section, as indicated in FIG. 4.

Figure 4A:
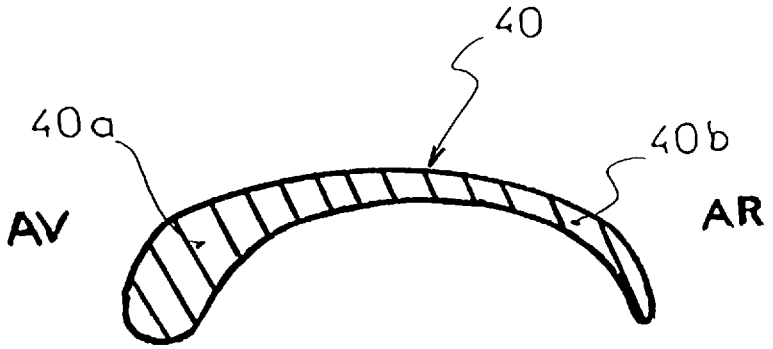
FIGS. 4*a*, 4*b* and 4*c* are similar views to FIG. 4, representing three different embodiments.
Figure 4B:
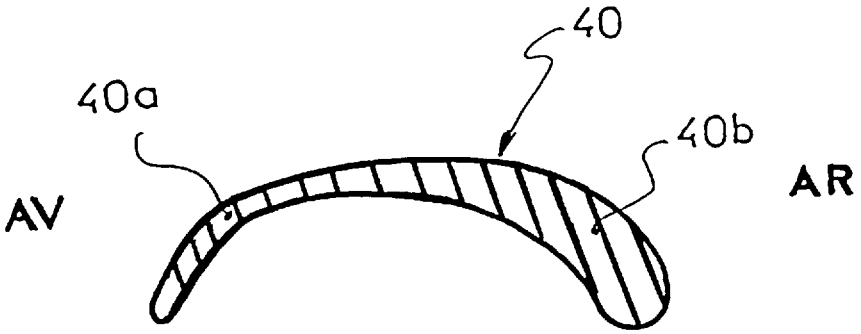

According to a possible variation, said thickness can vary in part or over the entire transverse section, with the front wall portions (40*a*) possibly having greater thickness than the rear wall portions (40*b*), as illustrated in FIG. 4*a*, or, in reverse, as illustrated in FIG. 4*b*, where the front portion (40*a*) has a lesser thickness than the rear portion (40*b*).

Figure 4C:
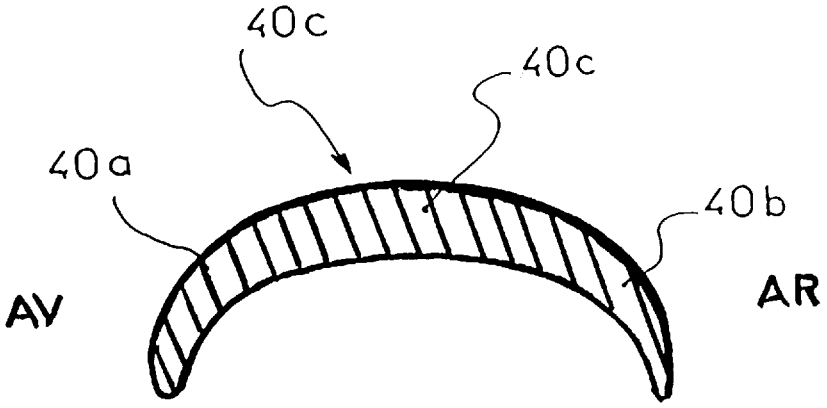

The central portion (40*c*) connecting the front portion (40*a*) and the rear portion (40*b*) can be thicker than said front (40*a*) and rear (40*b*) portions, as, for example, illustrated in FIGS. 4*c* and 6*c*.

Figure 5:
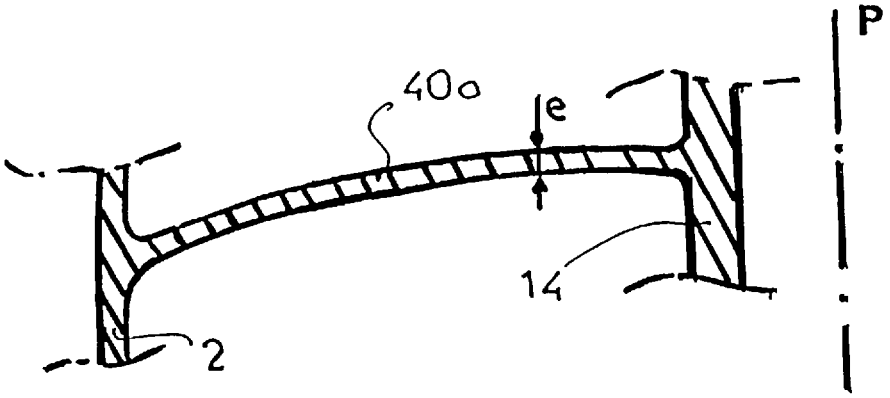
Figure 5A:
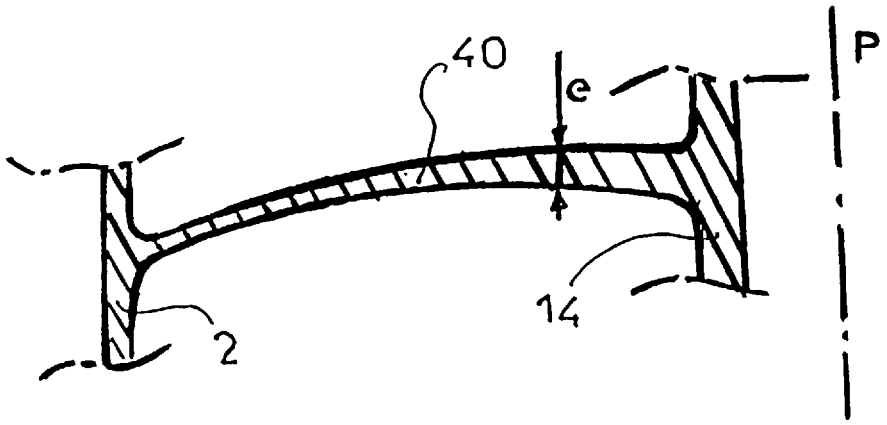
FIGS. 5*a* and 5*b* are views similar to FIG. 5, representing two different embodiments.
Figure 5B:
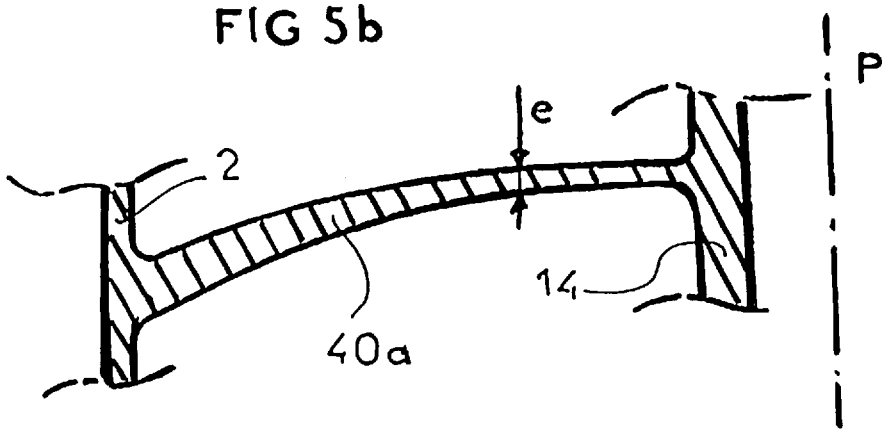

It should also be noted that the wall thickness can be constant longitudinally against the long profile of the transverse axis (YY'), as illustrated in FIG. 5, but it can also vary, for example, it can be thicker in the vicinity of plane P and become thinner toward the peripheral frame (2) as illustrated in FIG. 5*a*, or, conversely as represented in FIG. 5*b*, where the thickness in the vicinity of plane P is less significant and increases toward frame (2).

Figure 7:
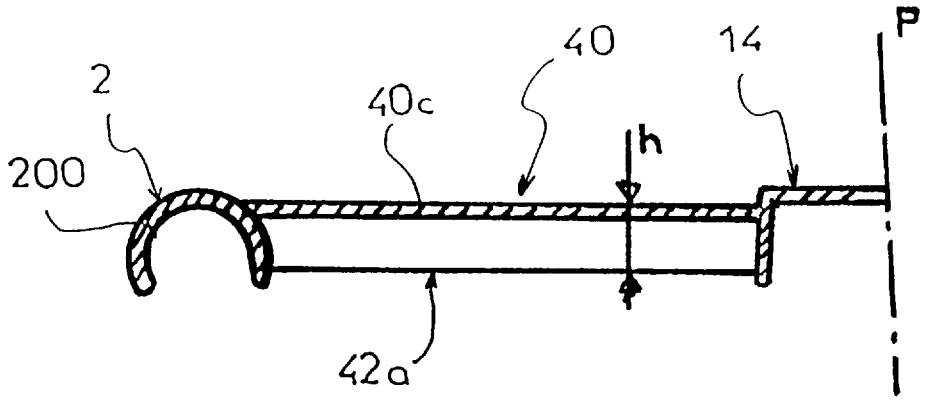
FIG. 7 is a sectional view according to CC of a wall.
Figure 7A:
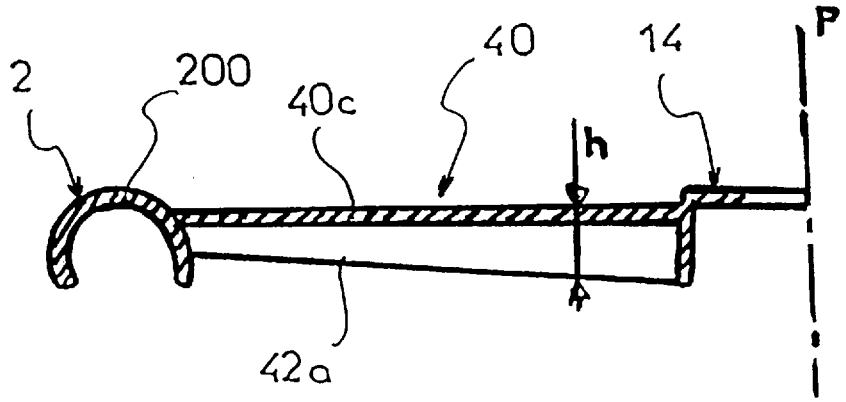
FIGS. 7*a* and 7*b* are views similar to FIG. 7, representing two different embodiments.
Figure 7B:
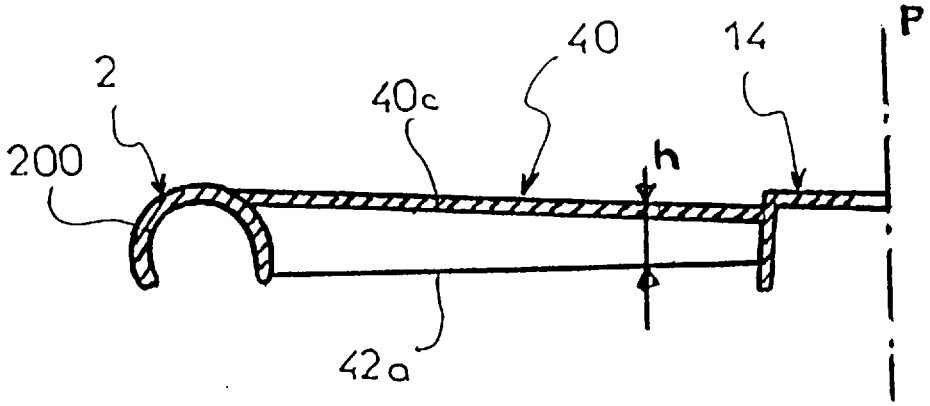

FIG. 7 is a sectional view according to (CC) at the level of the transverse axis (YY'). One notes that the height (h) of the profile is constant, that is to say, the height (h) is the same over the entire length of the profile. Naturally, it can also be different and variable height can be provided and it can, for example, diminish from the central part (14) toward the peripheral frame (2), as illustrated in FIG. 7*a*, or, conversely, increase from the central part (14) toward the peripheral frame (2), as represented in FIG. 7*b*.

Figure 3:
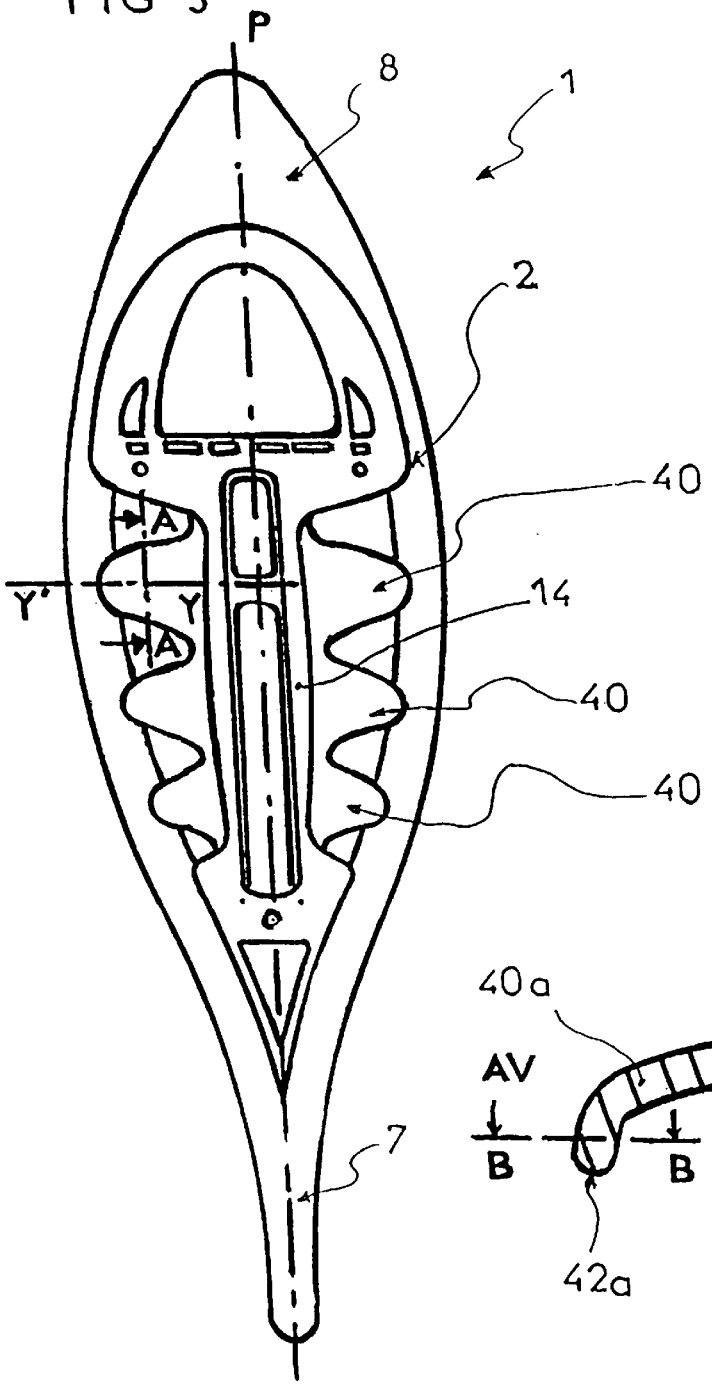
Figure 8A:
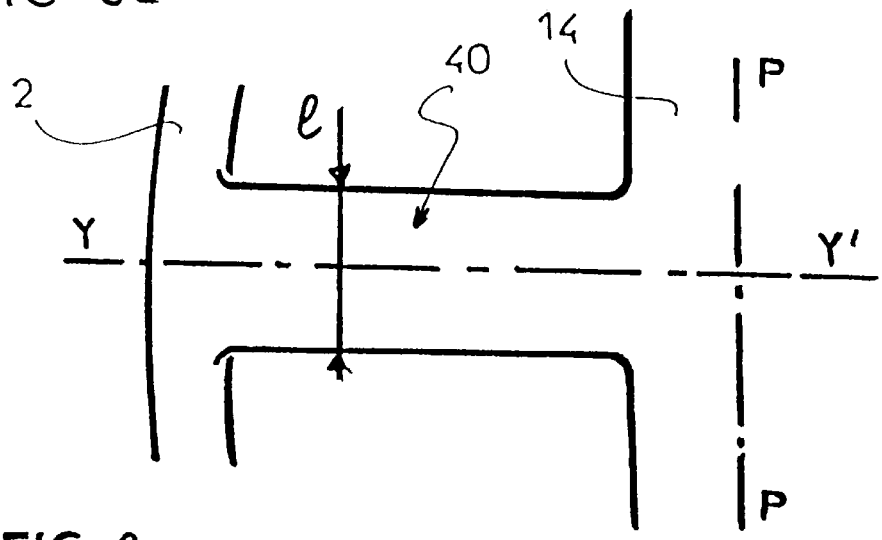
FIGS. 8, 8*a* and 8*b* are bird's eye views of different embodiments of the support wall.
Figure 8:
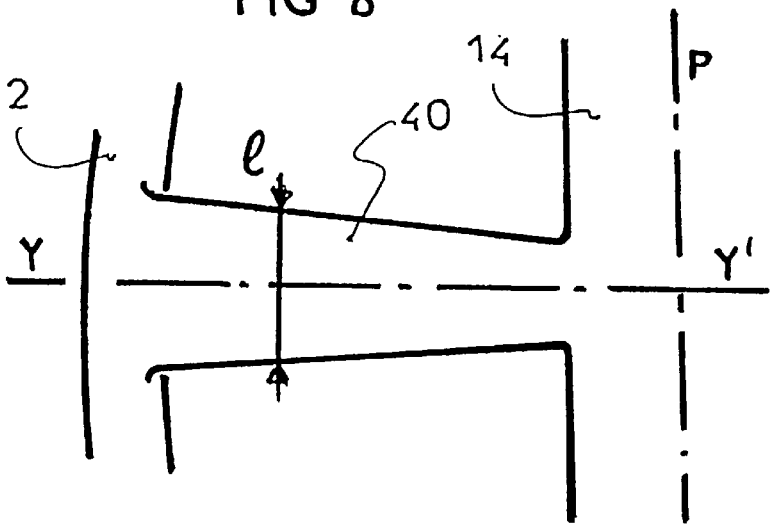
Figure 8B:
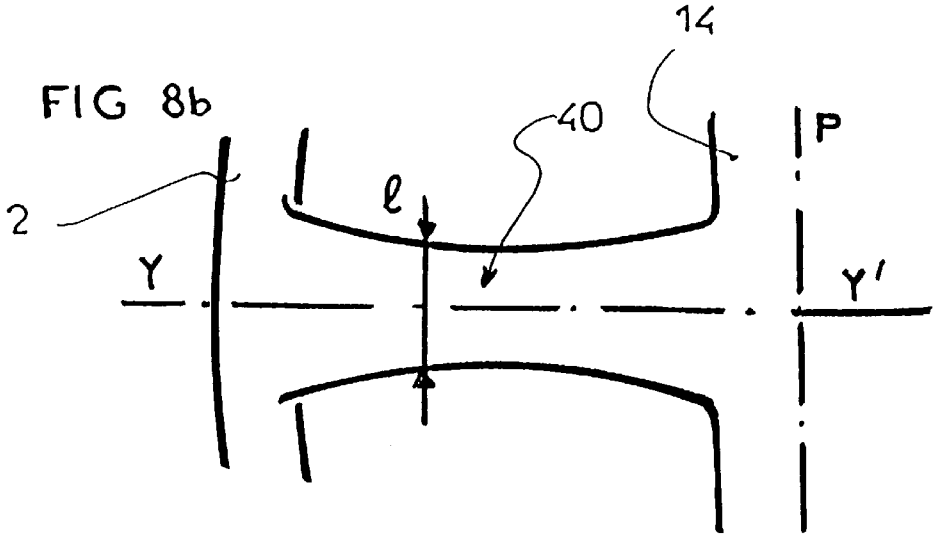

According to the preferred mode of embodiment, the width (1) of the profile constituting the support walls (40) diminishes from the center toward the peripheral frame, as illustrated in FIGS. 1 and 3. However, it is also possible that the width increases from the center toward the peripheral frame, as is represented in FIG. 8, or it can be constant as represented in FIG. 8*a*, or, in fact, have a mixed configuration as illustrated in FIG. 8*b*.

Figure 9:
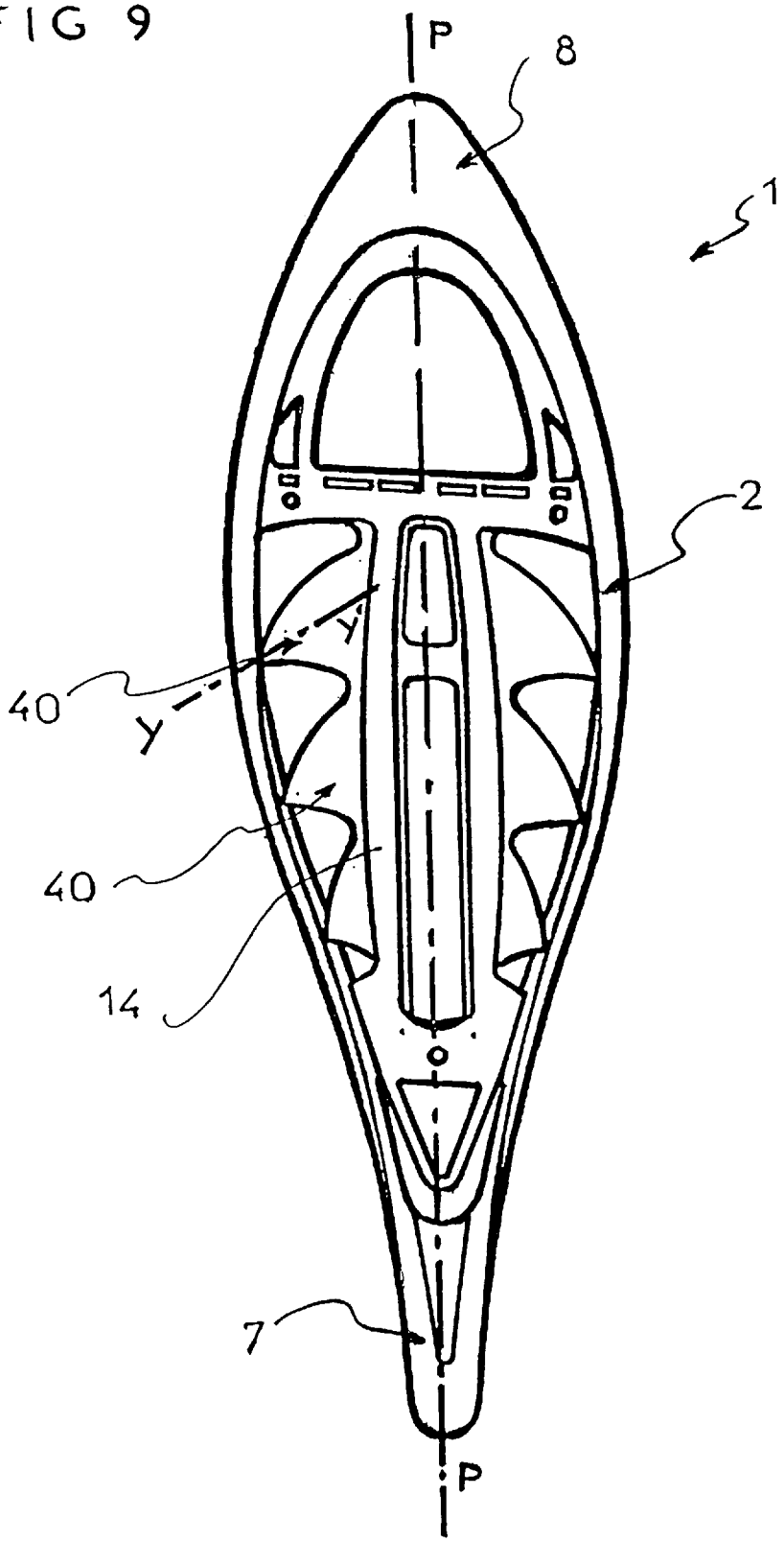
FIG. 9 is a similar view to FIG. 3 demonstrating a different embodiment.

The form of said support walls (40) can comprise, as illustrated in FIG. 3, a symmetrical axis, slightly transverse (YY') so that the front (40*a*) and rear (40*b*) walls may be symmetrical relative to this axis, or they may be totally asymmetrical as in the specific embodiment illustrated in FIG. 9.

Moreover, the portions of the front (40*a*) and rear (40*b*) walls have their respective lower edges (42*a*, 42*b*) located in the same horizontal plane, as illustrated in FIGS. 4, 4*a*, 4*b*, 4*c*, 6*a*, 6*b*, and 6*c*. But the arrangement may also be as represented in FIGS. 10*a* and 10*b*.

Figure 10A:
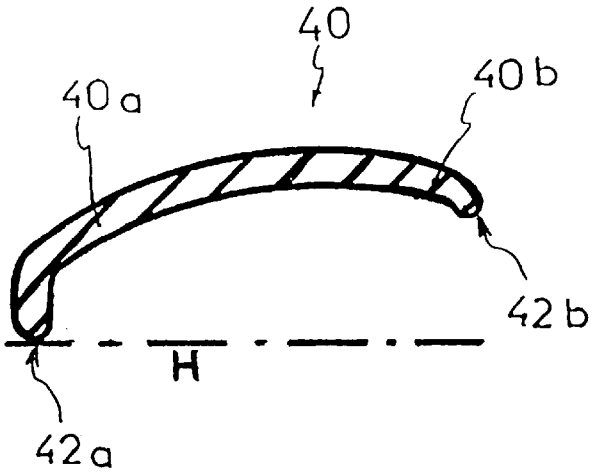
FIGS.10*a* and 10*b* are sectional views according to AA of a support wall section according to other embodiment variations.
Figure 10B:
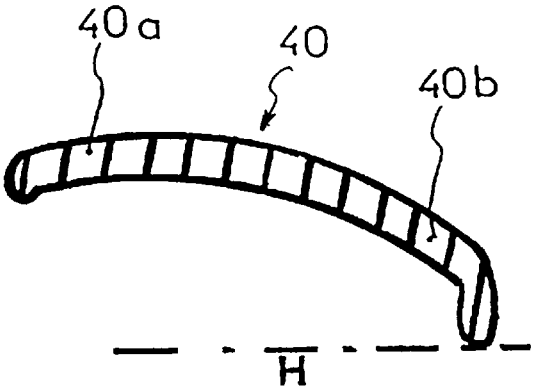

Thus, the lower edge (42*a*) of the front wall portion (40*a*) can continue in a horizontal plane (H) at a lower level than the one containing the lower edge (42*b*) of the rear wall portion (40*b*), as represented in FIG. 10*a*, or, conversely, the lower edge (42*b*) of the rear wall portion (40*b*) can be at a lower level than the lower edge (42*a*) of the front wall (40*a*), as illustrated in FIG. 10*b*. Moreover, two different support walls (40) can have the lower edges of their front (40*a*) and/or rear (40*b*) wall portions contained in two different horizontal planes.

Figure 11:
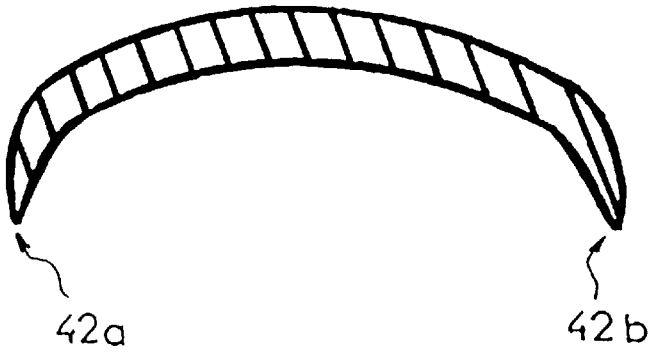
FIG. 11 represents a sectional view according to AA of a transverse section of a support wall, whose lateral edges form a ridge.

According to the preferred mode of embodiment, the lower edges (42*a*, 42*b*) constituting the extremities of the front and rear portions—in other words—by intersection of the upper and lower surfaces (41*a*, 41*b*) of the walls (40), have a cambered shape. It is apparent that said lateral edges could present a ridge, formed by an acute angle between the external surfaces (41*a*, 41*b*), without, however, going beyond the protected area of the invention, as illustrated in FIG. 11. Moreover, according to a possible variation, said lateral edge of the ridge can present a toothed profile or have small teeth, permitting easier progression on a slope of hard snow.

Figure 12:
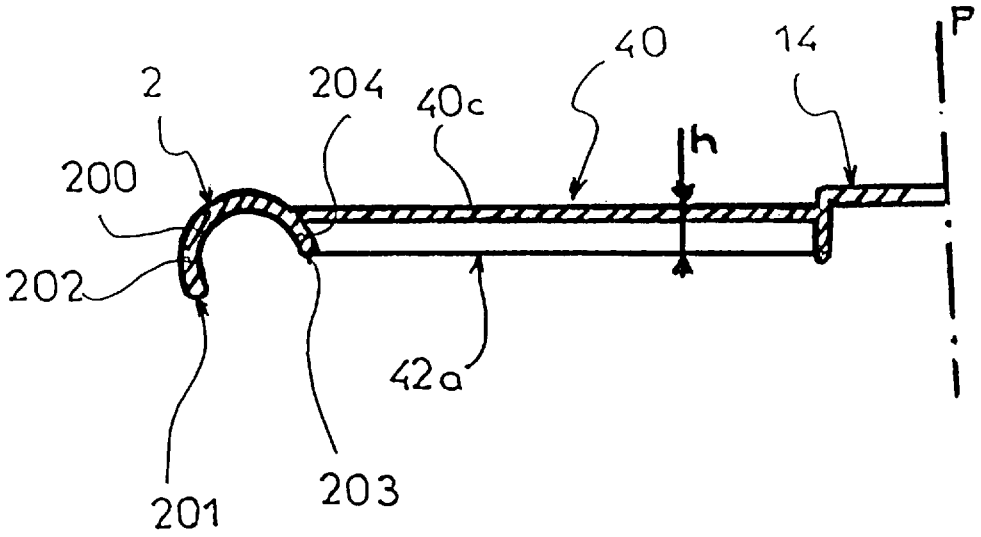
FIG. 12 is a view similar to FIG. 7, demonstrating a variation in embodiment.

It should be noted, as is quite clearly evidenced in FIGS. 7, 7*a* and 7*b*, that the peripheral frame (2) is beneficially constituted by a profile, open toward the bottom, formed by a wall (200) curved, for example, slightly cylindrically, said wall not being re-closed against itself in order to form an open box toward the bottom. FIG. 12 is a variation of embodiment of the peripheral frame, according to which the lower border (201) of the external wall portion (202) is lower than the lower border (203) of the internal wall portion (204).

It goes without saying that the invention is not limited to the embodiments described and represented by way of examples, but that it also comprises all technical equivalents or combinations of same.

We claim:

1. A snow shoe comprising:

a peripheral frame delimiting an interior zone;

a screen defined by a set of internal support walls, at least one of the support walls extending transversely and having a transverse profile, the support walls defining a box open toward the bottom, the support walls including at least one front wall portion extending outwardly from a top toward a front and downwardly toward a bottom and a rear wall portion extending outwardly from the top toward a rear and downwardly toward the bottom, such that the front and rear wall portions converge toward the top.

2. The snow shoe according to claim 1, wherein the profile is symmetric relative to an axis which is perpendicular to the transverse profile.

3. The snow shoe according to claim 1, wherein the profile is asymmetric relative to an axis which is perpendicular to the transverse profile.

4. The snow shoe according to claim 1 wherein a thickness of at least one of the front wall portion and the rear wall portion of the support wall varies.

5. The snow shoe according to claim 1 wherein an edge of the front wall portion and an edge of the rear wall portion are in a common horizontal plane.

6. The snow shoe according to claim 1 wherein an edge of the front wall portion and an edge of the rear wall portion are in different horizontal planes.

7. The snow shoe according to claim 1 wherein the snow shoe has a longitudinal plane of symmetry.

8. A snow shoe comprising:

a peripheral frame delimiting an interior zone;

a screen defined by a set of internal support walls, at least one of the support walls extending transversely and having a transverse profile, the support walls forming a box open toward the bottom, the support walls including at least one front wall portion extending toward the front and toward the bottom and a rear wall portion extending toward the rear and the bottom, a width of the support wall varying between a center and the peripheral frame.

9. The snow shoe according to claim 8, wherein the width of the support walls diminishes from the center toward the peripheral frame.

10. The snow shoe according to claim 8, wherein the width of the support walls increases from the center toward the peripheral frame.

11. A snow shoe comprising:

a peripheral frame delimiting an interior zone;

a screen defined by a set of internal support walls, at least one of the support walls extending transversely and having a transverse profile, the profile having a height which varies, the support walls forming a box open toward the bottom, the support walls including at least one front wall portion extending toward the front and toward the bottom and a rear wall portion extending toward the rear and the bottom.

12. A snow shoe comprising:

a peripheral frame delimiting an interior zone;

a screen defined by a set of internal support walls, at least one of the support walls extending transversely and having a transverse profile, the profile having a cambered shape, the support walls forming a box open toward the bottom, the support walls including at least one front wall portion extending toward the front and toward the bottom and a rear wall portion extending toward the rear and the bottom.

13. A snow shoe comprising:

a peripheral frame extending around an open interior zone;

a binding support portion disposed centrally in the interior zone;

a plurality of downwardly concave support wall portions extending transversely between the central portion and the peripheral frame, at least one of the support wall portions having a flexibility that varies over its length.

14. The snow shoe according to claim 13 wherein each of the support wall portions has a downwardly extending front edge portion and a downwardly extending rear edge portion, the front and rear edge portions varying in at least one of width, height, thickness, spacing and an angle of divergence to vary the support wall portion flexibility.

15. The snow shoe as set forth in claim 14 wherein the support wall portions have a cross-section between the front and rear edge portions which is thicker towards one of the front and rear edge portions and thinner toward the other.

16. The snow shoe as set forth in claim 14 wherein the downward extending front and rear edge portions have different heights adjacent the central portion and the peripheral frame.

17. The snow shoe of claim 13 wherein the support wall portions flexibility varies according to at least one of a width, a height, and a thickness of the support wall portion.

18. A snow shoe comprising:

a peripheral frame extending around an open interior zone;

a binding support portion disposed centrally in the interior zone;

a plurality of downwardly concave support wall portions extending transversely between the central portion and the peripheral frame, each of the support wall portions having a downwardly extending front edge portion, a downwardly extending rear edge portion, and an arcuate portion between the front and rear edge portions.

19. A snow shoe comprising:

a peripheral frame extending around an open interior zone;

a binding support portion disposed in a central part of the interior zone;

a plurality of downwardly concave support wall portions extending transversely between the central portion and the peripheral frame, the support wall portions being wider adjacent the central part and narrower adjacent the peripheral frame, each of the support wall portions having a downwardly extending front edge portion and a downwardly extending rear edge portion.

* * * * *